US006165116A

United States Patent [19]

White

[11] Patent Number: 6,165,116

[45] Date of Patent: Dec. 26, 2000

[54] METHOD AND APPARATUS FOR CREATING A DISCONTINUITY IN A STACK INTERFOLDED SHEETS

[75] Inventor: Barton J. White, Marinette, Wis.

[73] Assignee: Green Bay Engineering Corp., DePere, Wis.

[21] Appl. No.: 09/228,708

[22] Filed: Jan. 12, 1999

[51] Int. Cl.[7] ..... B31B 1/14

[52] U.S. Cl. ..... 493/360; 493/359; 493/374; 270/39.06

[58] Field of Search ..... 270/39.01, 39.05, 270/39.06, 32; 493/357–360, 344, 374

[56] References Cited

U.S. PATENT DOCUMENTS

| | | | |
|---|---|---|---|
| 4,163,548 | 8/1979 | Nystrand . | |
| 4,717,135 | 1/1988 | Hathaway . | |
| 4,721,295 | 1/1988 | Hathaway . | |
| 4,750,723 | 6/1988 | Herd et al. . | |
| 4,770,402 | 9/1988 | Couturier . | |
| 4,778,165 | 10/1988 | Buck . | |
| 4,778,441 | 10/1988 | Couturier . | |
| 4,824,425 | 4/1989 | DuFresne . | |
| 4,824,426 | 4/1989 | DuFresne | 270/39.06 |
| 5,005,816 | 4/1991 | Stemmler et al. . | |
| 5,067,698 | 11/1991 | Stemmler . | |
| 5,088,707 | 2/1992 | Stemmler . | |
| 5,147,273 | 9/1992 | Rottmann et al. | 270/39.06 |
| 5,310,398 | 5/1994 | Oneyama | 270/39.06 |

*Primary Examiner*—Eugene Kim

*Attorney, Agent, or Firm*—Andrus, Sceales, Starke & Sawall, LLP

[57] ABSTRACT

A system and method for creating a discontinuity in a stack of interfolded sheets in which folding rolls cooperate to interfold staggered sheets supplied in two streams of sheets, each of which is severed from a web of material. When a desired sheet count is attained, a sheet in one of the streams of sheets is folded onto itself so as to create a discontinuity in one of the streams of sheets. The folded sheet is formed by maintaining a leading portion of the sheet in engagement with a separating one roll while maintaining a trailing portion of the sheet in engagement with another roll, with the two rolls being positioned to form a nip therebetween and rotating in opposite directions. Once the sheet has attained a predetermined position on the two rolls, engagement of the leading portion of the sheet with the separating roll is released while engagement of the sheet with the other roll is maintained to define a crease in the sheet, with the leading portion of the sheet being folded back onto the trailing portion of the sheet. The folded sheet forms a gap in the sheet supplied in one of the streams of sheets which, when the sheets are supplied to the interfolding rolls, functions to create a discontinuity in the interfolded stack to facilitate separation of a portion of the stack from the remainder of the stack.

21 Claims, 6 Drawing Sheets

METHOD AND APPARATUS FOR CREATING A DISCONTINUITY IN A STACK INTERFOLDED SHEETS

BACKGROUND AND SUMMARY OF THE INVENTION

This invention relates to a system for interfolding sheets, such as paper toweling, and more particularly to an interfolding system which is capable of forming a discontinuity in a stack of interfolded sheets to enable the stack to be separated at predetermined locations according to a desired sheet count.

Conventional sheet interfolding systems sever a pair of webs into sheets which are then supplied to a nip formed by a pair of folding rolls. The sheets are supplied to the folding rolls in two staggered streams, and the folding rolls are operable to interfold the sheets and to discharge the interfolded sheets to form a stack. Various mechanisms are known to separate the stack to a desired sheet count downstream of the folding rolls. Examples of such mechanisms are disclosed in Hathaway U.S. Pat. No. 4,721,295 issued Jan. 26, 1988 and Couturier U.S. Pat. No. 4,770,402 issued Sep. 13, 1988. The '402 patent discloses counting fingers at the discharge of the folding rolls which count the number of sheets discharged to a vertically movable table. When a predetermined count is attained, a pair of fingers are moved into the discharged path of the interfolded sheets. One of the fingers engages the top of the stack and is moved downwardly along with the table to separate the stack and enable it to be discharged from the table. The other finger supports the sheets discharged from the folding rolls while the separated stack is being discharged from the table, and the table is then again moved upwardly to engage the bottom of the subsequent stack, and the process is repeated. The Hathaway '295 patent shows a generally similar system. While systems of this type are understood to operate in a generally satisfactory manner, they entail certain drawbacks such as the complexity and cost associated with the vertically movable tables and fingers and the mechanisms for inserting the fingers into the discharge area of the folding rolls. Further, since the stack of interfolded sheets is continuous, systems of this type must provide sufficient vertical movement to completely separate the interfolded panels from each other underneath the folding rolls.

Stemmler U.S. Pat. No. 5,088,707 discloses a system for forming a gap in a stream of sheets discharged from a pair of folding rolls. The '707 patent contemplates a storage roll located adjacent one of the folding rolls, which is operable to remove a sheet from one of the folding rolls and to place the removed sheet onto the successive sheet. In this manner, a gap is formed in the supply of sheets from one of the webs, and a double sheet is interfolded adjacent the gap. The gap facilitates separation of the stack after discharge from the folding rolls, since vertical movement of the stack is not required in order to separate the panels of the interfolded sheets. While this solution eliminates the need for the complicated counting fingers and alternating stack supporting mechanisms disclosed in the '402 and '295 patents, it also is somewhat disadvantageous in that the stack includes a double folded sheet, which results in the stack having two sheets at either its top or bottom which will be obtained when the stack is cut into length and ultimately placed into a dispenser. Further, the '707 patent discloses removal of a sheet from a folding roll and subsequently depositing the sheet back onto the successive sheet while on the folding roll, which requires modifications to the folding roll and involves the possibility that the removed sheet may be placed out of alignment or registration with the successive sheet when the removed sheet is placed back onto the folding roll.

It is an object of the present invention to provide a simplified system and method for creating a discontinuity in a stack of interfolded sheets. It is a further object of the invention to provide such a system and method which requires no interaction with the folding rolls. Yet another object of the invention is to provide such a system and method which eliminates a double sheet at the top or bottom of a stack, and which does not involve the difficulties associated with removing a sheet from the stream and subsequently replacing the sheet in the stream. A still further object of the invention is to provide such a system and method which is relatively simple in its components and operation and which involves modification of relatively few components of an existing interfolding system.

In accordance with one aspect of the invention, a sheet interfolding system for forming a stack of interfolded sheets from a pair of webs includes a pair of bed rolls to which the pair of webs are supplied and a severing arrangement which cooperates with each bed roll to sever each web into a series of sheets. A pair of folding rolls are arranged to receive the sheets from the pair of bed rolls and to interfold the sheets to form a stack of interfolded sheets at a discharged defined by the folding rolls. The sheets follow a supply path between the bed rolls and the folding rolls. A selectively operable gap forming arrangement is located upstream of the folding rolls, and is operable to selectively move at least the leading portion of one sheet out of the supply path and to move a trailing portion of the same sheet downstream in the supply path to form a gap in the supply of sheets from one of the bed rolls. The leading portion of the sheet is subsequently returned to the supply path upstream of the gap. The gap in the supply of sheets is operable to create a discontinuity in the stack of interfolded sheets to facilitate separation of a portion of the stack from the remainder of the stack after discharge from the folding rolls. The selectively operable gap forming arrangement is preferably in the form of a pair of oppositely rotating rolls which define a nip through which a stream of sheets from one of the bed rolls passes upstream of the folding rolls. The leading portion of the at least one sheet is moved out of the supply path by engagement of the leading portion of the sheet downstream of the nip with a first one of the pair of rolls. A second one of the pair of rolls is operable to advance a trailing portion of the sheet through the nip while the leading portion of the sheet is engaged with the first roll. In a preferred embodiment, the second roll is in the form of a bed roll, and the severing arrangement is in a form of a knife roll which cooperates with the bed roll to sever the web into sheets. The pair of rolls are preferably operable to fold the sheet onto itself. To accomplish this, the leading portion of the sheet is engaged with the first roll downstream of the nip while the trailing portion of the sheet is advanced through the nip by rotation of the second roll. After the trailing portion of the sheet has at least partially passed through the nip, engagement of the leading portion of the sheet with the first roll is released while rotation of the second roll is continued. Upon continued rotation of the second roll, the leading portion of the sheet is folded back onto the trailing portion, to form a folded sheet which is located immediately downstream of the gap formed by removal of the leading portion of the sheet from the supply path. The folded sheet is then discharged and interfolded with the remaining sheets, and the gap functions to form a discontinuity in the stack of sheets discharged from the folding rolls.

The invention further contemplates a method of creating a discontinuity in a stack of interfolded sheets formed at the discharge of a pair of folding rolls. The method contemplates forming a gap in a first stream of sheets which is supplied to the folding rolls along with a second stream of sheets. The gap in the first stream of sheets is formed upstream of the folding rolls by folding at least one of the sheets in the first stream of sheets onto itself to create a folded sheet which defines the gap in the first stream of sheets. Simultaneously, the supply of sheets in the second stream of sheets is maintained, and the first and second streams of sheets are supplied to the folding rolls. As noted above, the gap functions to form a discontinuity in the stack of interfolded sheets discharged from the folding rolls. The step of folding the sheet is preferably carried out on one of the bed rolls by lifting a leading portion of the sheet off of the bed roll while maintaining a trailing portion of the sheet on the bed roll. The bed roll is rotated to advance the trailing portion of the sheet relative to the leading portion, and the leading portion of the sheet is then returned to the bed roll so as to overlie the trailing portion of the sheet. In a preferred form, the step of lifting the leading portion of the sheet off of the bed roll is carried out by positioning a separating roll adjacent the bed roll and selectively operating the separating roll to engage the leading portion of the sheet with the separating roll.

In one form, the leading portion of the sheet is engaged with the separating roll by supplying suction to a surface of the separating roll located adjacent the bed roll and subsequently rotating the separating roll and the bed roll in opposite directions. The trailing portion of the sheet may be maintained in engagement with the bed roll by supplying suction to a surface of the bed roll which underlies the trailing portion of the sheet. The leading portion of the sheet is subsequently returned to the bed roll after the separating roll has attained a predetermined rotational position relative to the bed roll by cutting off the supply of suction to the surface of the separating roll.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
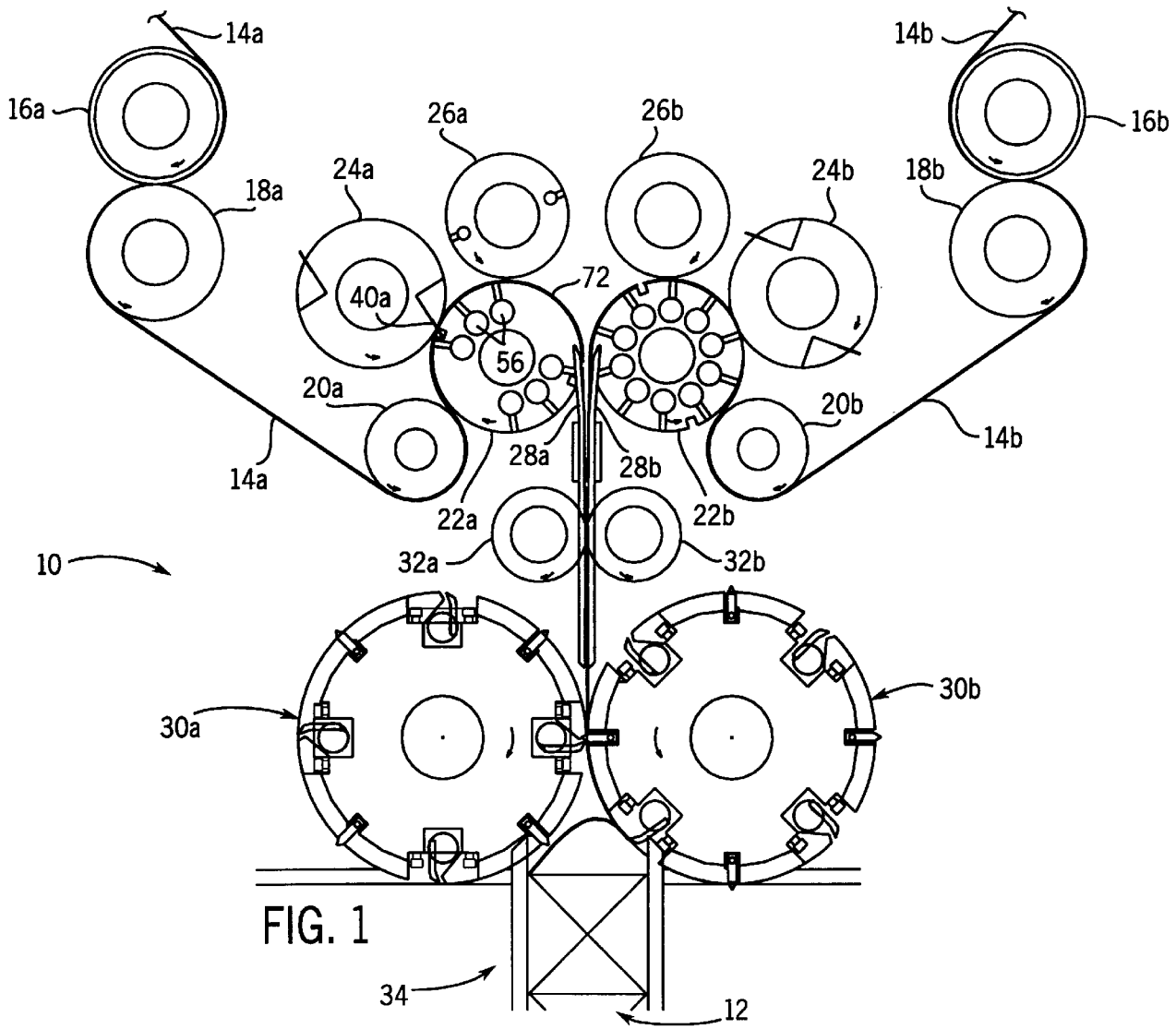
FIG. 1 is a schematic side elevation view of a sheet interfolding system for carrying out the sheet folding method, and incorporating the sheet folding arrangement, according to the present invention.

FIG. 1 illustrates the overall construction of a sheet interfolding system 10 for use in creating a stack 12 of interfolded sheets from a pair of webs 14*a*, 14*b*. System 10 is generally symmetrical about a center line, and many components on one side have the same construction 30 and operation as those on the other. Such common components will be designated with a similar reference character modified using the designation "a" on one side and "b" on the other.

Web 14*a* is trained about a pair of pull rolls 16*a*, 18*a* which rotate in opposite directions, passing through a nip defined therebetween. From pull roll 18*a*, web 14*a* is supplied to a lower pressure roll 20*a*. Web 14*a* is trained about lower pressure roll 20*a*, and extends through a nip defined between lower pressure roll 20*a* and an adjacent surface defined by a bed roll 22*a* located above and inwardly of lower pressure roll 20*a*. A knife roll 24*a* is located adjacent bed roll 22*a*. In a manner to be explained, knife roll 22*a* functions to sever web 14*a* into a series of successive sheets, each of which passes through a nip defined by bed roll 22*a* in combination with an upper pressure roll 26*a* located inwardly of knife roll 24*a*.

In a similar manner, web 14*b* is trained about pull rolls 16*a*, 18*b*, a lower pressure roll 20*b* and a bed roll 22*b* for severing by a knife roll 24*b* into a series of successive sheets which pass through a nip defined by an upper pressure roll 26*b* in combination with bed roll 22*b*.

A series of guide fingers 28*a* and 28*b* are spaced along the length of bed rolls 22*a* and 22*b* at the discharge area defined therebetween. The upper ends of guide fingers 28*a*, 28*b* are received within grooves (not shown) formed in bed rolls 22*a*, 22*b*, respectively. The successive sheets cut from web 14*a* form a first stream of sheets supplied to the space between guide fingers 28*a* and 28*b*, and the sheets from web 14*b* form a second stream of sheets which are staggered relative to the stream of sheets supplied from web 14*a*, in a conventional manner.

Guide fingers 28*a*, 28*b* extend from the discharge of bed rolls 22*a*, 22*b* to a location spaced slightly vertically above a nip defined by a pair of conventional folding rolls 30*a*, 30*b*. The streams of sheets supplied from bed rolls 22*a* and 22*b* pass between guide fingers 28*a* and 28*b*, and downward movement of the sheets is aided by assist rolls 32*a*, 32*b* which extend into spaces between adjacent guide fingers 28*a* and 28*b* for moving the sheets downwardly toward the discharge of guide fingers 28*a* and 28*b*. Once discharged from between guide fingers 28*a* and 28*b*, the staggered streams of sheets are interfolded by folding rolls 30*a* and 30*b* in a conventional manner and are supplied to a discharge magazine 34 located vertically below the discharge of folding rolls 30*a*, 30*b*, where stack 12 is formed for subsequent separation.

Figure 2:
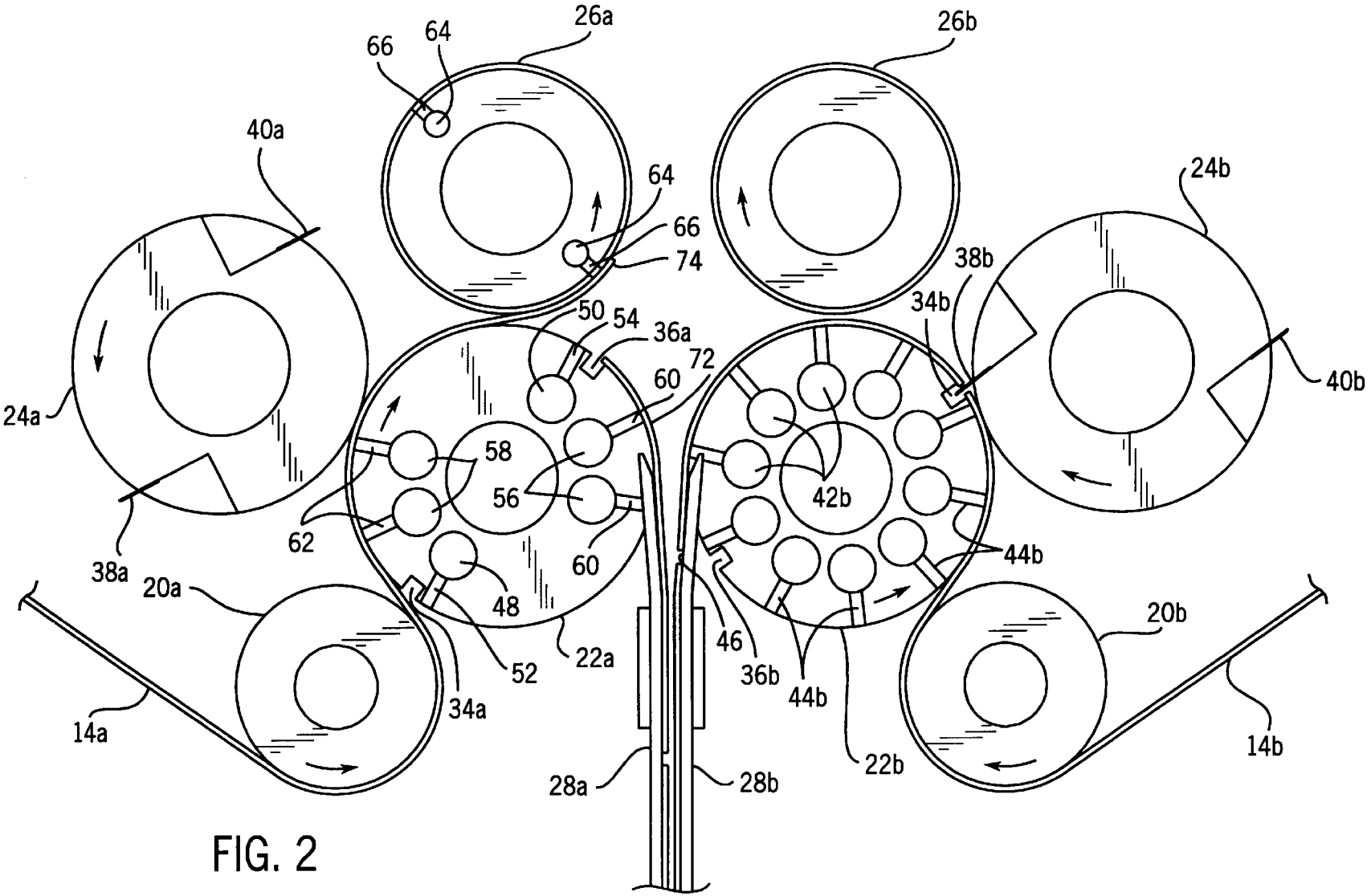
FIG. 2 is an enlarged partial side elevation view of the sheet intefolding system of FIG. 1 illustrating an initial stage of moving the leading portion of a sheet out of the sheet supply path for initiating folding of the sheet to form a gap in the supply of sheets.

Referring to FIGS. 1 and 2, bed roll 22*a* includes a pair of opposed grooves 34*a*, 36*a*, and bed roll 22*b* includes a pair of opposed grooves 34*b*, 36*b*. A pair of knives 38*a* and 40*a* are mounted opposite each other on knife roll 24*a*. Rotation of bed roll 22*a* and knife roll 24*a* in opposite directions results in passage of knife 38*a* into groove 34*a* and knife 40*a* into groove 36*a*, so as to sever web 14*a* into a series of sheets.

Similarly, knives 38*b* and 40*b* are mounted to knife roll 24*b* and are adapted to be received within grooves 34*b*, 36*b*, respectively, in bed roll 22*b* for severing web 14*b* into a series of successive sheets. The position of grooves 34*a* and

36*a* of bed roll 22*a* is angularly offset relative to that of grooves 34*b* and 36*b* of bed roll 22*b*, as are the positions of knifes 38*a* and 40*a* of knife roll 24*a* relative to knives 38*b* and 40*b* of knife roll 24*b*. In this manner, the sheets formed from webs 14*a* and 14*b* are in a staggered relationship, wherein the separation between adjacent sheets in one of the streams of sheets is offset from the separation between adjacent sheets in the other stream of sheets, preferably by one-half of a sheet length.

Bed roll 22*b* includes a series of vacuum passages 42*b* along its length, and a series of suction ports 44*b* are located along the length of each vacuum passage 42, to convey suction from each vacuum passage 42*b* to the surface of bed roll 22. Vacuum passages 42*b* are equally radially spaced about the interior of bed roll 22*b* and, similarly, suction ports 44*b* open onto the outer surface of bed roll 22*b* at an equal radial spacing about the periphery of the outer surface of bed roll 22*b*.

In a manner as is known, negative air pressure is provided to vacuum passages 42*b* at lower pressure roll 20*b* to positively engage web 14*b* with the outer surface of bed roll 22*b* upon discharge of web 14*b* from lower pressure roll 20*b*. The supply of negative air pressure to vacuum passages 42*b* is maintained throughout counterclockwise rotation of bed roll 22*b* from approximately its 5 o'clock position to approximately its 10 o'clock position, to maintain web 14*b* in engagement with web 14*b* while it is being severed into individual sheets by knives 38*b* and 40*b* passing into grooves 34*b* and 36*b*, respectively, upon rotation of bed roll 22*b* and knife roll 24*b*. As bed roll reaches its approximately 10 o'clock position during its rotation, negative air pressure to vacuum passages 42 is cut off, to enable the leading edge of each sheet, such as shown at 46 in FIG. 2, to be released from bed roll 22*b* and to move onto guide finger 28*b*.

After the leading edge of the sheet has been discharged from bed roll 22*b*, the supply of negative air pressure to vacuum passages 42*b* remains cut off and then again resumes as the outer surface of bed roll 22*b* again approaches the point of contact with web 14*b* adjacent lower pressure roll 20*b*, at approximately the 5 o'clock position of bed roll 22*b*.

Upper pressure roll 26*b* has an outer surface coated with rubber or other tractive material, and functions to maintain tension on web 14*b* as it is severed on bed roll 22*b* by knives 38*b* and 40*b*. Upper pressure roll 26*a* also functions to apply pressure to the sheet after the sheet is severed and prior to discharge, to smooth the sheet and prevent deformities in the sheet before it is discharged from bed roll 22*b*.

The components on the right hand or "b" side of system 10, as described above, operate to provide a continuous, uninterrupted supply of sheets to the space between guide fingers 28*a* and 28*b*, in a manner as is known.

The construction of bed roll 22*a* varies from that of bed roll 22*b*. As shown in FIG. 2, bed roll 22*a* has a pair of leading edge vacuum passages 48, 50, located adjacent grooves 34*a*, 36*a*, respectively. Leading edge suction ports 52, 54 extend between vacuum passages 48, 50, respectively, and the outer surface of bed roll 22*a*, opening onto the bed roll outer surface adjacent grooves 34*a*, 36*a*, respectively. A pair of trailing portion vacuum passages 56 are located rotationally upstream of leading edge vacuum passage 48, and a pair of trailing portion vacuum passages 58 are located rotationally upstream of leading edge vacuum passage 50. Suction ports 60, 62 extend from trailing portion vacuum passages 56, 58, respectively, opening onto the outer surface of bed roll 22*a* rotationally upstream of the location at which suction ports 52, 54, respectively, open onto the outer surface of bed roll 22*a*. As with vacuum passages 42*b*, vacuum passages 48, 50, 56 and 58 are formed throughout the length of bed roll 22*a*, and suction portions 52, 54, 60 and 62 are spaced along the length of their respective vacuum passages so as to communicate suction to the exterior of bed roll 22*a*.

Upper pressure roll 26*a* performs the same functions as upper pressure roll 22*b* in the severing of sheets from web 14*a*. In addition, upper pressure roll 26*a* is provided with a pair of opposed vacuum passages 64 formed throughout its length, with suction ports 66 spaced along the length of upper pressure roll 26 and opening onto its outer surface. Vacuum passages 64 and suction ports 66 are spaced 180 degrees apart from each other.

In operation, the left hand or "a" side of system 10 functions as follows. As shown in FIG. 1, a sheet 72 is illustrated as having been cut by knife 40*a*. Trailing portion vacuum passages 56 are ON such that negative air pressure is supplied through passages 56 and ports 60 to maintain the trailing part of sheet 72 in engagement with bed roll 22*a*. Leading edge vacuum passage 48 is off, such that the leading edge of sheet 72 is being discharged from bed 20 roll 22*a* into the space between guide fingers 28*a* and 28*b*. Operation of both the "a" and "b" sides of system 10 as illustrated in FIG. 1 continues uninterrupted, such that the two streams of staggered sheets are supplied to folding rolls 30*a* and 30*b*. A revolution sensor is interconnected with upper pressure roll 26*a* for counting its revolutions, which is used to provide a count as to the number of sheets supplied to folding rolls 30*a* and 30*b*. When the sheet count reaches a predetermined value, the series of steps illustrated in FIGS. 2–5 occur in order to create a discontinuity in the stack of sheets discharged from folding rolls 30*a* and 30*b*.

Referring to FIG. 2, suction to leading edge vacuum passage 50 is maintained as the leading edge 74 of web 14*a* upstream from sheet 72 passes the nip between upper pressure roll 26*a* and bed roll 22*a*. At the nip, suction is supplied to vacuum passage 64 in upper 30 pressure roll 26*a*, which is located over the leading edge 74 of web 14*a*. The suction in vacuum passage 64 is supplied through suction ports 66 to the outer surface of upper pressure roll 26*a*, and is greater than the suction supplied to web 14*a* by leading edge vacuum passage 50 and its associated suction ports 54. The suction in suction ports 66 of upper pressure roll 26*a* thus overcomes that of suction ports suction ports 54 of bed roll 26*a*, to draw the leading portion of 35 web 14*a* into engagement with upper pressure roll 26*a*. Upper pressure roll 26*a* thus functions as a separating roll to move a part of web 14*a*, which is destined to become a severed sheet, out of the normal supply path of sheets from web 14*a*. Suction is supplied to trailing portion vacuum passages 58 in bed roll 22*a*, to maintain a trailing portion of web 14*a*, which is destined to become the trailing end of a sheet severed from web 14*a*, in engagement with bed roll 22*a*.

Figure 3:
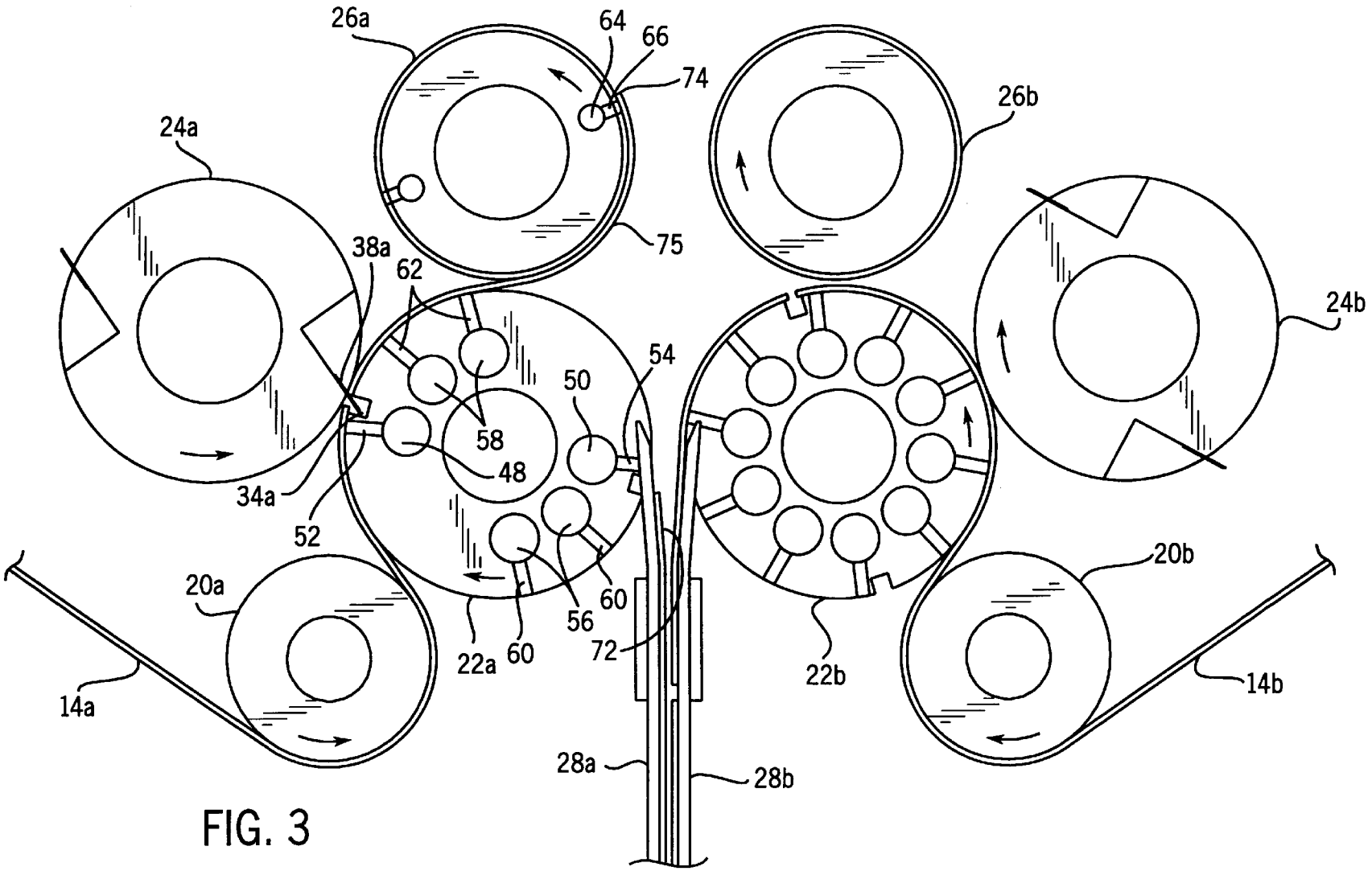
FIG. 3 is a view similar to FIG. 2, showing a subsequent position of the components of the system for advancing the leading portion of the sheet.

Rotation of bed roll 22*a* and upper pressure roll 26*a* continues in opposite directions, so that bed roll 22*a* and upper pressure roll 26*a* attain the position as shown in FIG. 3. In this position, tension is maintained on web 14*a* by engagement of web 14*a* in the nip between lower pressure roll 20*a* and bed roll 22*a*, and in the nip between upper pressure roll 26*a* and bed roll 22*a*. Knife roll 24*a* is rotated such that knife 38*a* is received in groove 34*a*, to sever web 14*a* to form a sheet, as shown at 75. The supply of suction to trailing portion vacuum passages 58 is continued, so as to maintain engagement of the trailing portion of sheet 75 with bed roll 22*a*. When knife 38*a* severs web 14*a* to form sheet 75, approximately half the length of sheet 75 is on bed roll 22*a* and approximately half the length of sheet 75 is on upper pressure roll 26*a*. Immediately after sheet 75 is formed by the action of knife 38*a* severing web 14*a*, suction to upper pressure roll vacuum passage 64 is cut off so as to release engagement of leading edge 74 of sheet 75 with upper pressure roll 26*a*. The supply of suction to trailing portion vacuum passages 58 in bed roll 22*a* is maintained as the leading suction port 62 in bed roll 22*a* passes the nip between bed roll 22*a* and upper pressure roll 26*a*.

Figure 4:
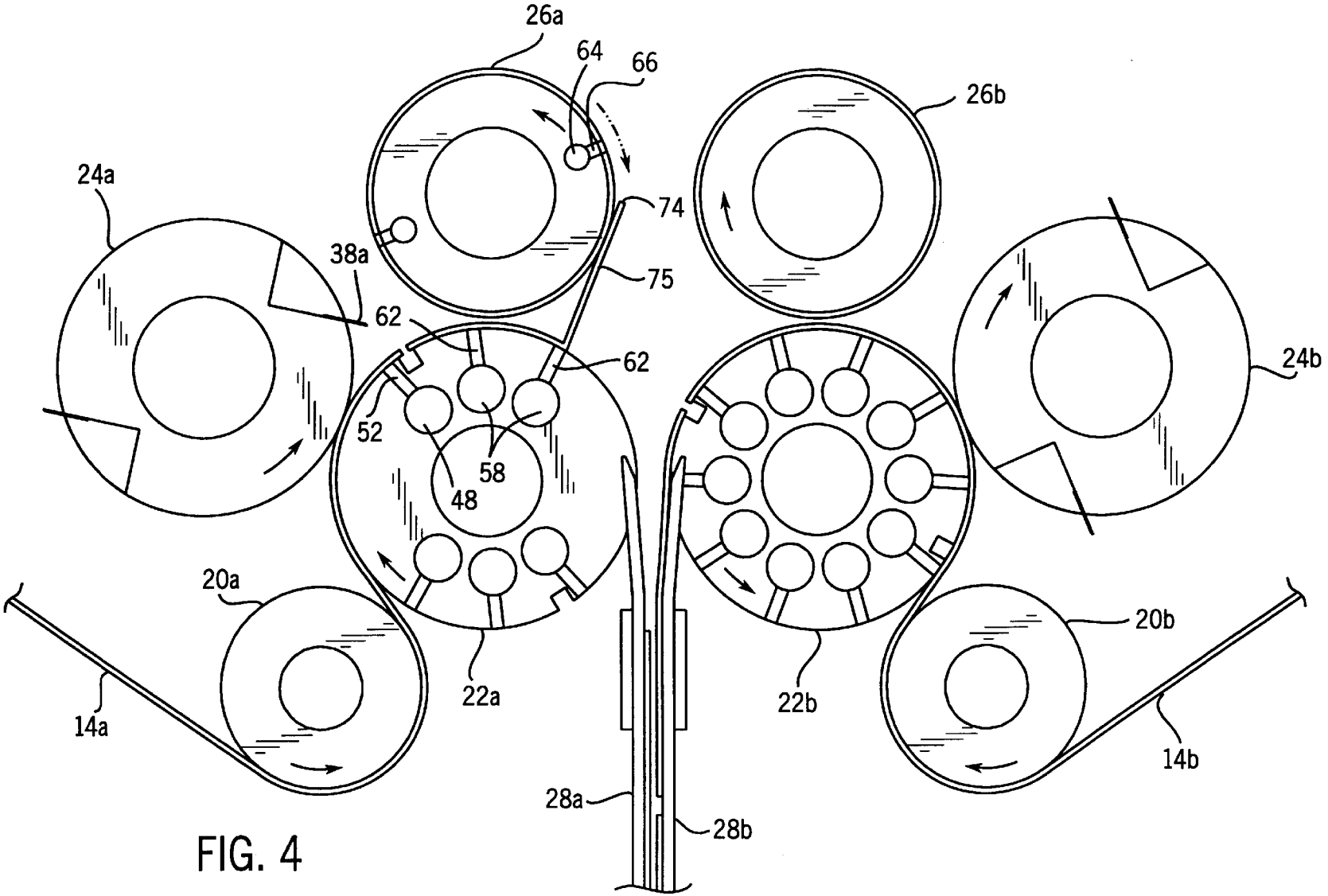
FIG. 4 is a view similar to FIGS. 2 and 3, showing release of the leading portion of the sheet to form a fold in the sheet.
Figure 5:
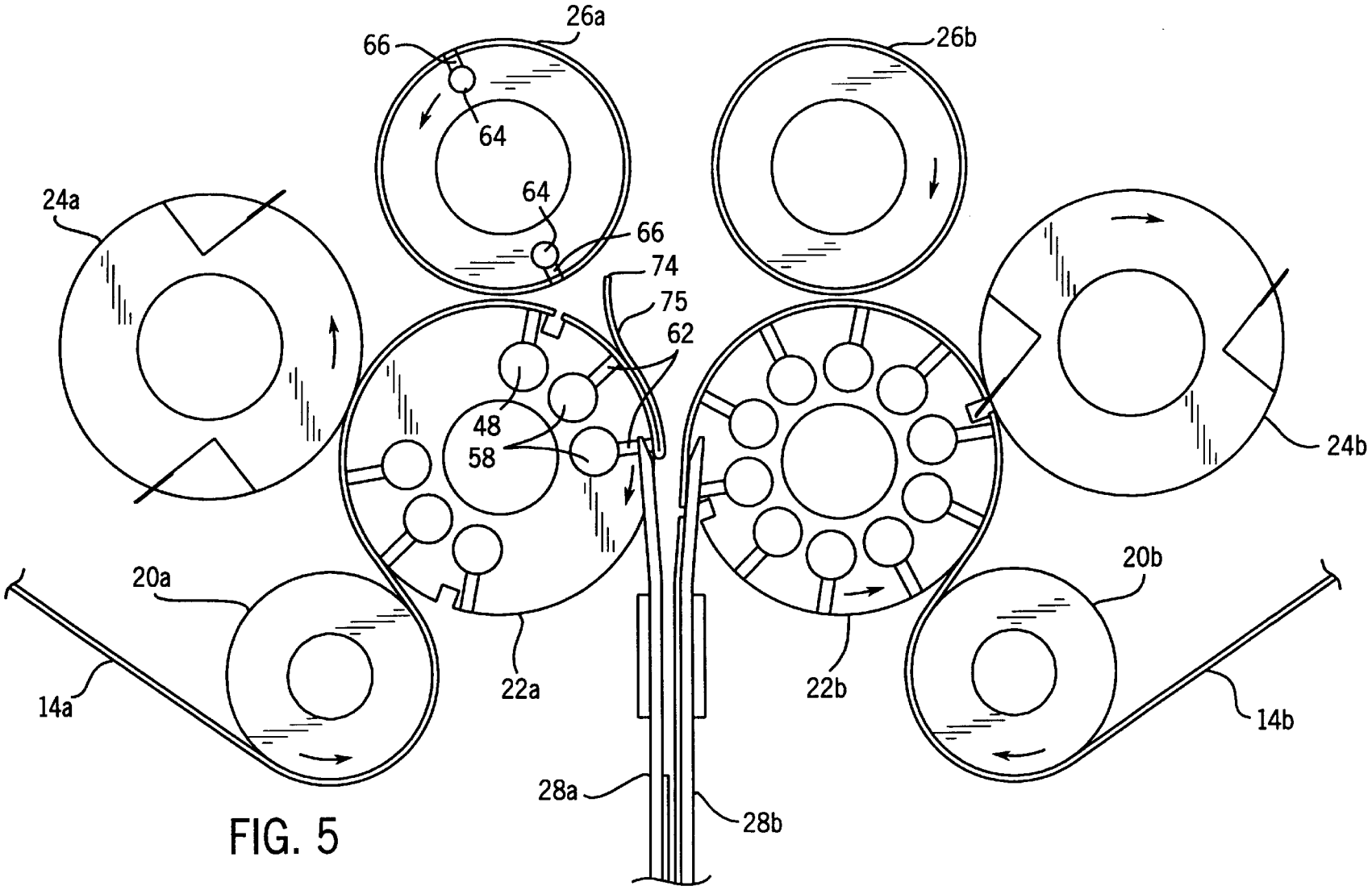
FIG. 5 is a view similar to FIGS. 2–4, showing the folded sheet being discharged from the bed roll.

As shown in FIG. 4, the release of the leading edge 74 of sheet 75 from upper pressure roll 26*a*, while maintaining the suction in trailing portion suction ports 62, functions to form a crease in sheet 75 at the leading suction port 62, and rotation of bed roll 22*a* is continued so as to advance the crease in sheet 75 toward the discharge defined by guide fingers 28*a*, 28*b*. Rotation of bed roll 22*a* continues as shown in FIG. 5, and suction is maintained to trailing portion vacuum passages 58. This maintains the trailing portion of sheet 75 in contact with bed roll 22*a* while the leading portion of sheet 74 is folded back onto the trailing portion of sheet 75. As the folded sheet 75 approaches guide fingers 28*a* and 28*b*, suction in trailing portion vacuum passages 56 is cut off to enable the folded sheet 75 to be discharged onto guide fingers 28*a*. The crease of folded sheet 75 is located upstream from the point of separation between the adjacent sheets from web 14*b* entering the space between guide fingers 28*a* and 28*b* immediately downstream from folded sheet 75. That is, the crease of folded sheet 75 is spaced from the trailing end of sheet 46, such that the trailing half of sheet 46 does not have any sheet from web 14*a* overlapping it.

Figure 6:
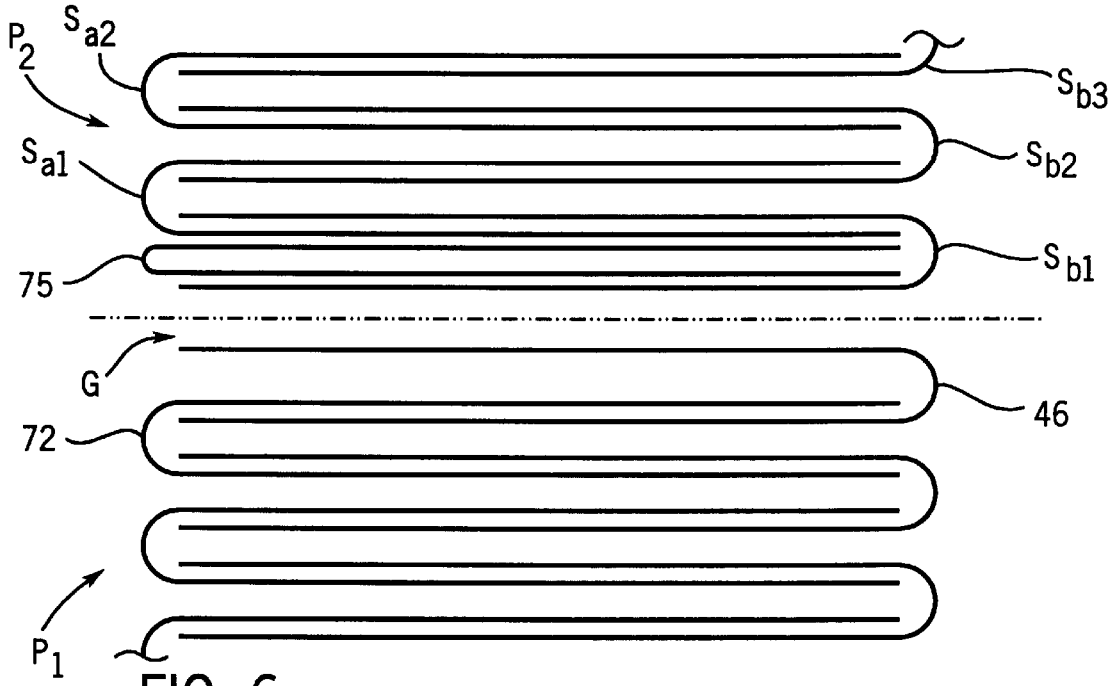
FIG. 6 is a side view showing a portion of a stack discharged from the folding rolls and incorporating a discontinuity therein created by supply of the folded sheet to the folding rolls as illustrated in FIGS. 2–5.

With operation of system 10 as shown in FIGS. 2–5 and described above, the supply of folded sheet 75 to folding rolls 30*a* and 30*b* forms a discontinuity in the stack 12 of interfolded sheets, as shown in FIG. 6. The trailing half of sheet 46 does not overlap any part of sheet 75, such that a gap G is formed between the trailing half of sheet 46 and the leading half of the next adjacent folded sheet, shown at $S_{b1}$. Folded sheet 75 is tucked entirely inside the next adjacent folded sheet $S_{b1}$. Interfolding of subsequent sheets, such as shown at $S_{b1}$, $S_{a1}$, $S_{b2}$, $S_{b2}$, and $S_{b3}$, continues above gap G to form a pair of separated portions of the stack, shown at $P_1$, and $P_2$.

The discontinuity in stack 12 formed by gap G can thus be exploited to easily separate the stack 12 since the adjacent panels at the discontinuity are not interlocked or interfolded. Each discontinuity or gap G is formed at the appropriate sheet count, such that the stack can be separated into individual "logs", such as defined by portions $P_1$ and $P_2$, which are then discharged for wrapping and cutting. Various known mechanisms can be employed to accomplish separation of the stack, such as shown in Stemmler U.S. Pat. No. 5,088,707 or in any other manner as is known in the art.

After folded sheet 75 has been formed and supplied to folding rolls 30*a* and 30*b*, normal operation of both the "a" and "b" sides of system 10 is resumed so as to continue supplying the separate streams of staggered sheets for normal interfolding. When the desired count is once again reached, the folding operation as illustrated in FIGS. 2–5 is again carried out to form a discontinuity in the stack.

The drawings illustrate a specialized upper pressure roll 26*a* on only one side of system 10 for carrying out the sheet folding operation of the invention to form a discontinuity in the stack. It should be understood, however, that an upper pressure roll like 26*a* can also be employed in place of conventional pressure roll 26*b* on the "b" side of system 10, and bed roll 22*b* may be replaced with a bed roll having a construction and operation like that of bed roll 22*a*. In this manner, the sheet folding operation can occur on either side of system 10, which may be required when a stack having an odd number of sheets is to be formed.

Various alternatives and embodiments are contemplated as being within the scope of the following claims particularly pointing out and distinctly claiming the subject matter regarded as the invention.

I claim:

1. A method of creating a discontinuity in a stack of interfolded sheets, wherein the stack is formed at the discharge of a pair of folding rolls which are supplied with staggered first and second streams of sheets by a pair of bed rolls, each of which cooperates with a severing arrangement to sever the sheets from a web, wherein the severed sheets in the first and second streams of sheets converge at a location upstream of the pair of folding rolls, comprising the steps of:

forming a gap in the first stream of sheets, wherein the gap is formed upstream of the folding rolls by folding at least one of the sheets in the first stream of sheets onto itself to create a folded sheet in the first stream of sheets which defines the gap, while maintaining the supply of sheets in the second stream of sheets, wherein the folded sheet is folded at a location upstream of the location at which the sheets in the first and second streams of sheets converge and before the first and second streams of sheets are supplied to the folding rolls; and supplying the first stream of sheets, including the folded sheet, to the folding rolls along with the second stream of sheets, wherein the folding rolls are operable to interfold the sheets in the first and second streams of sheets, including the folded sheet in the first stream of sheets;

wherein the gap in the first stream of sheets is operable to form a discontinuity in the stack of interfolded sheets when the sheets in the first and second streams of sheets are interfolded by the folding rolls.

2. The method of claim 1, wherein the step of folding at least one of the sheets in the first stream of sheets onto itself is carried out on one of the bed rolls.

3. The method of claim 2, wherein the folding step is carried out by lifting a leading portion of the at least one sheet off of the bed roll while maintaining a trailing portion of the sheet on the bed roll, and subsequently returning the leading portion of the sheet toward the bed roll so as to overlie the trailing portion of the sheet while the trailing portion of the sheet remains on the bed roll.

4. The method of claim 3, wherein the step of lifting a leading portion of the sheet off of the bed roll is carried out by positioning a separating roll adjacent the bed roll and selectively operating the separating roll to engage the leading portion of the sheet with the separating roll, and wherein the step of subsequently returning the leading portion of the sheet toward the bed roll is carried out by releasing engagement of the leading portion of the sheet with the separating roll while maintaining the trailing portion of the sheet in contact with the bed roll.

5. The method of claim 4, wherein the step of selectively operating the separating roll to engage the leading portion of the sheet with the separating roll is carried out by providing suction to a surface of the separating roll located adjacent the bed roll while rotating the separating roll, and wherein the step of releasing engagement of the leading portion of the sheet with the separating roll is carried out by cutting off the suction provided to the surface of the separating roll when the separating roll reaches a predetermined point in its rotation relative to the bed roll.

6. A method of creating a separation in a stack of interfolded sheets, wherein the stack is formed at the discharge of a pair of folding rolls located downstream of a pair of bed rolls, each of which interacts with a severing mechanism to alternately sever sheets from a pair of webs, wherein the sheets severed from the pair of webs converge at a location upstream of the pair of folding rolls, and wherein the sheets are discharged from the bed rolls to the folding rolls, comprising the steps of:

folding one of the sheets onto itself upstream of the pair of folding rolls while the sheet is engaged with a first one of the bed rolls to form a folded sheet which defines a gap in the supply of sheets from the first bed roll while maintaining an uninterrupted supply of sheets from a second one of the bed rolls, wherein the folded sheet is folded at a location upstream of the location at which the pair of webs converge and before the sheets from the first and second bed rolls are supplied to the folding rolls;

subsequently discharging the folded sheet from the first bed roll; and supplying the sheets from the first bed roll, including the gap and the folded sheet, to the folding rolls while maintaining the uninterrupted supply of sheets from the second bed roll, wherein the folding rolls are operable to interfold the sheets from the first and second bed rolls, including the folded sheet, and wherein the gap defined by the folded sheet is operable to form a separation in the stack of interfolded sheets discharged from the folding rolls.

7. The method of claim 6, wherein the step of folding one of the sheets onto itself while the sheet is engaged with the first bed roll is carried out by lifting a leading portion of the sheet off of the first bed roll while maintaining engagement of a trailing portion of the sheet with the first bed roll, and subsequently placing the leading portion of the sheet onto the trailing portion of the sheet.

8. The method of claim 6, wherein the step of lifting a leading portion of the sheet off of the first bed roll is carried out by engaging the leading portion of the sheet with a separating roll located adjacent the first bed roll, and simultaneously rotating both the separating roll and the first bed roll in opposite rotational directions.

9. The method of claim 8, wherein the step of engaging the leading portion of the sheet with the separating roll is carried out by supplying suction to a surface of the separating roll at a location where a surface of the separating roll is located adjacent a surface of the first bed roll, and wherein the step of subsequently placing the leading portion of the sheet onto the trailing portion of the sheet is carried out by cutting off the supply of suction to the surface of the separating roll when the separating roll and the first bed roll reach a predetermined point in their rotation relative to each other, while maintaining engagement of the trailing portion of sheet with the first bed roll and continuing rotation of the first bed roll.

10. The method of claim 9, wherein the step of maintaining engagement of a trailing portion of the sheet with the first bed roll is carried out by supplying suction to a surface of the first bed roll at the trailing portion of the sheet during rotation of the first bed roll and the separating roll, and further comprising the step of cutting off the supply of suction to the surface of the first bed roll after the leading portion of the sheet is placed onto the trailing portion of the sheet to enable the folded sheet to be discharged from the first bed roll.

11. The method of claim 7, wherein the leading portion of the sheet is initially maintained in engagement with the first bed roll via suction supplied to a surface of the first bed roll, and wherein the step of lifting a leading portion of the sheet off of the first bed roll is carried out by means of a separating roll having a surface located adjacent a surface of the first bed roll, engaging the leading portion of the sheet with the separating roll by providing suction to a surface of the separating roll sufficient to overcome the suction supplied to the surface of the first bed roll, and rotating the separating roll in a direction of rotation opposite that of the first bed roll.

12. In an interfolded sheet stack forming system in which a stack of interfolded sheets is formed at the discharge of a pair of folding rolls which are supplied with first and second staggered streams of sheets, wherein the first and second streams of sheets converge at a location upstream of the pair of folding rolls, the improvement comprising separation means for forming a separation in the stack of interfolded sheets by folding at least one sheet from the first stream of sheets onto itself to form a folded sheet, wherein the separation means is located upstream of the location at which the first and second streams of sheets converge and wherein the separation means forms the folded sheet before the first and second streams of sheets are supplied to the folding rolls, wherein the folding rolls are operable to interfold the sheets in the first and second streams of sheets, including the folded sheet in the first stream of sheets, and wherein the folded sheet forms a discontinuity in the stack of sheets discharged from the folding rolls.

13. The improvement of claim 12, wherein the separation means comprises a pair of rolls defining a nip through which one of the streams of sheets passes.

14. The improvement of claim 13, wherein the pair of rolls rotate in opposite directions and are operable to selectively engage a leading portion of a sheet in the first stream of sheets with a first one of the pair of rolls downstream of the nip while engaging a trailing portion of the sheet with a second one of the pair of rolls upstream of the nip, wherein rotation of the pair of rolls passes the trailing portion of the sheet through the nip while the leading portion of the sheet is maintained in engagement with the first roll, and further including means for releasing engagement of the leading portion of the sheet with the first roll subsequent to passage of the trailing portion of the sheet through the nip, wherein the leading portion of the sheet is placed onto the trailing portion to form the folded sheet.

15. The improvement of claim 14, wherein the leading portion of the sheet is selectively engaged with the first roll by supplying suction to a surface of the first roll at the nip, and wherein the means for releasing engagement of the leading portion of the sheet with the first roll is operable to cut off the supply of suction to the surface of the first roll.

16. A sheet interfolding system for forming a stack of interfolded sheets from a pair of webs, comprising:

a pair of bed rolls to which the pair of webs are supplied;

a severing arrangement cooperating with each bed roll to sever the webs into sheets, wherein the sheets from the pair of webs converge at a location downstream of the pair of bed rolls;

a pair of folding rolls arranged to receive the sheets from the pair of bed rolls and to interfold the sheets to form a stack of interfolded sheets at a discharge defined by the folding rolls;

wherein the sheets follow a supply path from the bed rolls to the folding rolls; and a selectively operable gap forming arrangement located upstream of the folding rolls and upstream of the location at which the sheets from the pair of webs converge, wherein the gap forming arrangement is operable to selectively move at least a leading portion of at least one sheet out of the supply path and to move a trailing portion of the same sheet downstream into a supply path to form a gap in the supply of sheets from one of the bed rolls by movement of the leading portion of the sheet out of the supply path, wherein the gap forming arrangement is further operable to subsequently return the leading portion of the sheet to the supply path to form a folded sheet;

wherein the folding rolls are operable to interfold the sheets discharged from the pair of bed rolls including the folded sheet, and wherein the gap in the supply of sheets is formed before the sheets are supplied to the folding rolls and is operable to create a discontinuity in the stack of interfolded sheets to facilitate separation of a portion of the stack from the remainder of the stack.

17. The sheet interfolding system of claim 16, wherein the selectively operable gap forming arrangement comprises a pair of oppositely rotating rolls which define a nip through which a stream of sheets from one of the bed rolls passes upstream of the folding rolls, wherein the leading portion of the at least one sheet is moved out of the supply path by engaging the leading portion of the sheet downstream of the nip with a first one of the pair of rolls, wherein a second one of the pair of rolls is operable to advance a trailing portion of the sheet through the nip while the leading portion of the sheet is engaged with the first roll.

18. The sheet interfolding system of claim 17, wherein the first and second rolls are operable to fold the sheet by maintaining engagement of the trailing portion of the sheet downstream of the nip subsequent to engagement of the leading portion of the sheet with the first roll downstream of the nip, and releasing engagement of the leading portion of the sheet with the first roll to place the leading portion of the sheet onto the trailing portion of the sheet.

19. The sheet interfolding system of claim 18, wherein engagement of the trailing portion of the sheet with the second roll is carried out by supplying suction to the surface of the second roll which underlies the trailing portion of the sheet, and wherein the leading portion of the sheet is engaged with the first roll by means of suction supplied to a surface of the first roll, and wherein engagement of the leading portion of the sheet with the first roll is released by cutting off the supply of suction to the surface of the first roll.

20. The sheet interfolding system of claim 17, wherein the second roll comprises a first one of the bed rolls.

21. The sheet interfolding system of claim 20, wherein the first bed roll includes at least one recess and wherein the severing arrangement includes a knife adapted to be received within the recess for severing the web overlying the recess, and wherein the leading portion of the sheet is engaged with the bed roll upstream of the nip means of suction supplied to a surface of the bed roll adjacent the recess, wherein the supply of suction to the surface of the bed roll adjacent the recess downstream of the nip is overcome by engagement of the leading portion of the sheet with the first roll.

* * * * *